US006434349B1

(12) United States Patent
Shimizu et al.

(10) Patent No.: US 6,434,349 B1
(45) Date of Patent: Aug. 13, 2002

(54) IMAGE FORMING APPARATUS

(75) Inventors: Yasushi Shimizu, Toride; Junichi Kato, Kashiwa; Hiroshi Satoh, Ibaraki-ken; Masahiro Yoshida, Kashiwa; Hiroyuki Oba, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/895,187

(22) Filed: Jul. 2, 2001

(30) Foreign Application Priority Data

Jun. 30, 2000 (JP) ..... 2000-19943

(51) Int. Cl.[7] ..... G03G 15/02

(52) U.S. Cl. ..... 399/100; 399/50; 399/174; 399/176; 399/175

(58) Field of Search ..... 399/50, 100, 149, 399/150, 174, 175, 176

(56) References Cited

U.S. PATENT DOCUMENTS 5,809,379 A 9/1998 Yano et al. ..... 399/159
6,128,456 A * 10/2000 Chigono et al. ..... 399/176
6,134,407 A * 10/2000 Ishiyama et al. ..... 399/174

FOREIGN PATENT DOCUMENTS

JP 6-3921 1/1994

* cited by examiner

*Primary Examiner*—Arthur T. Grimley
*Assistant Examiner*—Hoang Ngo
(74) *Attorney, Agent, or Firm*—Fitzpatrick, Cella, Harper, & Scinto

(57) ABSTRACT

An image forming apparatus includes an image bearing member; a charge member, contactable to the image bearing member, for electrically charging the image bearing member, the charge member being capable of being supplied with a voltage; developing means for developing an electrostatic image formed on the image bearing member with a developer; wherein the charge member is rotatable so as to provide a first peripheral speed difference between a surface of charge member and a surface of the image bearing member when the image bearing member is charged for image formation; wherein there is provided a cleaning period for transferring the developer from the charge member to the image bearing member with a second peripheral speed difference, which is smaller than the first peripheral speed difference, between the surface charge member of and surface of the image bearing member, when a charging operation for the image formation is not effected to the image bearing member.

13 Claims, 6 Drawing Sheets

IMAGE FORMING APPARATUS

FIELD OF THE INVENTION AND RELATED ART

The present invention relates to an image forming apparatus such as an electrophotographic apparatus, an electrostatic recording apparatus or the like which produces images through an image forming process including a step of electrically charging an image bearing member such as a photosensitive member, a dielectric member or the like.

The image forming apparatus such as an electrophotographic apparatus requires an electric charging step of charging the image bearing member uniformly to a predetermined potential in order to form an electrostatic latent image on the image bearing member. For this purpose, a non-contact type corona charger or the like has been used as a means for the charging. However, the corona charger produces ozone and requires such a high voltage as approx. 10 KV has to be applied between the charging device and the image bearing member.

Recently, a charging means has been proposed to avoid these problems. In such a means, a charge member is directly contacted to the image bearing member and is supplied with a voltage by which the image bearing member is charged uniformly (so-called contact charging device).

A) Charging Roller

A typical contact charging device is a charging roller 2-X as shown in FIG. 6.

In the charging roller, the charge member 2-X-*a* is in the form of a roller (charging roller) having an electroconductive base roller and a surface layer of intermediate resistance layer. The charging roller 2-X-*a* is contacted to the image bearing member 1 at a predetermined pressure and is rotatably supported on bearings. It is rotated in the direction indicated by arrow b by rotation of the image bearing member 1 which is rotated in the direction indicated by an arrow a. Between the charging roller 2-X-*a* and the image bearing member 1, a predetermined charging bias voltage is applied from a voltage source S1 so that said image bearing member 1 is uniformly charged to a predetermined potential.

Here, the voltage applied to the roller may be (1) a DC voltage only or (2) a DC voltage biased with an AC voltage.

In the case of (1), in order to charge the image bearing member 1 to a potential of −600 V, the applied voltage is approx. −1300 V, and in the case of (2), the applied DC voltage is −600 V and the AC voltage is not less than 1500 Vpp.

The charging mechanism in these cases is based on the Paschen's law, and an electric discharge phenomenon arises in a region satisfying the Paschen's law in which the distance between the charging roller 2-X-*a* and the image bearing member 1 is within a predetermined range (region H in FIG. 6).

However, as will be understood from the charging mechanism, the contact charging device of this type creates the discharge which is the same as with the corona charger within a fine space region H, and therefore, the ozone is produced although the amount of ozone production is remarkably smaller than with the corona charger. The ozone produces oxide nitrogen, and if it is deposited on the image bearing member 1, an image defect is produced due to the low resistance of the deposited matter.

B) Injection Charging Device

This injection charging process system is proposed in Japanese Laid-open Patent Application Hei 6-3921 which is free of such a problem of ozone generation, and therefore, the voltage applied to the charging device can be further reduced.

The feature of the charging process is that surface potential of the charged image bearing member is substantially the same as the voltage applied to the charging device. This system does not use the electric discharge phenomenon, and charge injection occurs into the image bearing member by the transfer of electric charges between the surface of the image bearing member and the charge member contacted thereto.

(1) Magnetic Brush Charging Apparatus

In order to embody the injection charging process, some types of injection charging devices have been proposed.

A typical example is a magnetic brush type charging device 2-Y as shown in FIG. 7. The charging device comprises a magnet 2-Y-*a*, a non-magnetic charging sleeve 2-Y-*b* containing the magnet 2-Y-*a* therein, a magnet carrier (magnetic carrier, magnetic powder member) 2-Y-*c*, an electroconductive regulating blade 2-Y-*d* and a housing 2-Y-*e* and so on.

The magnet carrier 2-Y-*c* is made of magnetic material (particles) which is electroconductive.

The charging sleeve 2-Y-*b* is disposed in the housing 2-Y-*e* and is rotatable, and a part of the peripheral surface thereof is exposed to the outside through an opening of the housing. In the charging device 2-Y, the exposed portions of the charging sleeve 2-Y-*b* is faced to the image bearing member 1 with a predetermined small gap therebetween. The magnet 2-Y-*a* is not rotatable The magnet carrier 2-Y-*c* is retained in the housing 2-Y-*e*. A regulating blade 2-Y-*d* is provided in the opening of the housing 2-Y-*e* and provides a predetermined gap between the regulating blade 2-Y-*d* and the charging sleeve 2-Y-*b*.

The magnet carrier 2-Y-*c* in the housing 2-Y-*e* is magnetically attracted and retained in the form of a magnetic brush on the peripheral surface of the charging sleeve 2-Y-*b* by the magnetic field generated by the magnet 2-Y-*a*, and is fed by the rotation of the charging sleeve 2-Y-*b*. The layer thickness thereof is regulated to a predetermined thickness by the regulating blade 2-Y-*d*, and the layer is carried to the outside of the opening of the housing 2-Y-*e* to be brought into contact to the surface of the image bearing member 1. It rubs the surface of the image bearing member and returns into the housing 2-Y-*e* with the continuing rotation of the charging sleeve 2-Y-*b*.

The image bearing member 1 is rotated in the direction indicated by an arrow a, and the charging sleeve 2-Y-*b* is rotated in the direction indicated by an arrow S which is opposite from the rotational direction of the image bearing member 1 at the contact portion (charge portion) between the image bearing member 1 and the magnetic brush of the magnet carrier 2-Y-*c*. Thus, there is provided a peripheral speed difference between the magnetic brush of the magnet carrier 2-Y-*c* and the image bearing member 1 so that magnetic brush rubs in the surface of image bearing member 1 with the rotation of the charging sleeve 2-Y-*b*.

In the magnetic brush charging apparatus 2-Y of this example, the regulating blade 2-Y-*d* is supplied with a DC voltage of −600 V for example as a charging bias voltage from the voltage source S1. Therefore, the portion of the image bearing member 1 to which the magnetic brush of the magnet carrier 2-Y-*c* is contacted tends to acquire the same potential. This time, if the charge is injected from the magnet carrier 2-Y-*c* into the image bearing member 1 beyond an energy barrier at the surface of the image bearing member 1, then the image bearing member 1 is electrically charged. If it cannot be injected beyond the energy barrier or if the charge returns to the magnet carrier 2-Y-*c* when the magnet carrier 2-Y-*c* is brought out of contact from the image bearing member 1, then the image bearing member 1 is not charged. In the phenomenon, the energy barrier at the surface of the image bearing member 1 and a retention performance of the charge are important, and when the phenomenon is taking as a competitive reaction, the frequency of chances of contact between the magnet carrier 2-Y-*c* and the image bearing member 1 is important.

In order to raise the contact frequency, and the particle size of the magnet carrier 2-Y-*c* is reduced; the magnetic force provided by the magnet 2-Y-*a* is made stronger to increase the density of the magnetic brush of the magnet carrier 2-Y-*c*; and/or the peripheral moving direction of the charging sleeve 2-Y-*b* is made opposite from the peripheral moving direction of the image bearing member 1 at the charge portion to increase the relative speech between the image bearing member and the magnetic brush of the magnet carrier 2-Y-*c* is increased. These are effective to increase the number of contacts per unit time between the particles of the magnet carrier 2-Y-*c* and the image bearing member 1.

In this manner, the particles of the magnet carrier 2-Y-*c* which provide sites of charge injection into the image bearing member 1 can be contacted to the image bearing member at a high probability, by which the surface potential of the image bearing member 1 becomes substantially the same as −600 V applied to the regulating blade 2-Y-*d*, and a uniform charging (in a microscopic sense) is accomplished (2) Furbrush Charging Device An injection charging device 2-Z of a type different from the magnetic brush type may use a furbrush roller 2-Z-*a* as the charge member as shown in FIG. 8.

In the furbrush type, the role of the magnetic brush of the magnet carrier 2-Y-*c* in the magnetic brush charging apparatus 2-Y is performed by an electroconductive fur.

The furbrush roller 2-Z-*a* comprises electroconductive soft fur at a high density, and fur tip portions are contacted to the surface of the image bearing member 1. The image bearing member 1 is rotated in the direction indicated by an arrow a, and the furbrush roller 2-Z-*a* is moved in the direction indicated by an arrow s which is opposite from the moving direction of the image bearing member 1 at the contact portion (charge portion) relative to the image bearing member 1.

Namely, the furbrush roller 2-Z-*a* is rotated with a peripheral speed difference relative to the image bearing member 1 to rub the surface of the image bearing member 1 by the furbrush.

The furbrush roller 2-Z-*a* is supplied with a predetermined DC voltage from a voltage source S1 as a charging bias voltage, so that surface of the image bearing member 1 is electrically charged.

(3) Sponge Charging Roller

As a further different type charging device (different from the magnetic brush type and the furbrush type), an injection charging device 2-A using a charging sponge roller 2-A-*e* as the charge member, is shown in FIG. 9, has been proposed.

In this type, the charging sponge roller 2-A-*a* has pores on the surface thereof which is rotated in contact with the image bearing member 1, and the pores contain electroconductive particles (charging-promotion particles) having a relatively low resistance. The electroconductive particles Z correspond to the magnet carrier 2-Y-*c* in the magnetic brush type and function as the injection site.

The image bearing member 1 is rotated into direction indicated by an arrow a, and the charging sponge roller 2-A-*a* is rotated in the opposite peripheral direction which is opposite from that of the image bearing member 1 at the contact portion (charge portion) between the image bearing member 1 and the charging sponge roller 2-A-*a*. The charging sponge roller 2-A-*a* is rotated with a peripheral speed difference relative to the image bearing member 1 to rub the surface of the image bearing member 1. In this case, the electroconductive particle Z is present in the contact nip between the charging sponge roller 2-A-*a* and the image bearing member 1. The charging sponge roller 2-A-*a* is supplied with a predetermined DC voltage as the charging bias voltage from a voltage source S1, so that surface of the image bearing member 1 is electrically charged.

In the injection charging devices such as the above-described magnetic brush charging apparatus, furbrush charging device and sponge charging roller, it is important that injection sites are assured between the charge member and the image bearing member in order to provide sufficient charging power, with high-efficiency and for a long term. In the long term use, if even a small amount of developer or the like remains on the image bearing member in the form of residual toner as a result of image transfer, the developer is supplied to the charge member Most of them are collected back into the developing device. However, there exists such a developer accumulated on the charge member. The accumulation amount may be large as the case may be. If this occurs, the resistance of the charge member increases with a result of lowered injection efficiency, and therefore, the charging property is not satisfactory.

When an excessive amount of the developer is present on the charging member, the developer on the charge member is not sufficiently charged on the charge member and is easily transferred onto the image bearing member even if the charging member has sufficient charging power. Therefore, the developer is not sufficiently collected back into the developing device in the developing process and is transferred onto the transfer material with the result of image defect, as the case may be.

If the excessive amount of accumulated developer on the charge member is transferred onto the image bearing member, the developer blocks in the image explosion light in the exposure process with the result of disturbance to the latent image formation.

Even in the case that amount of the residual developer is so minimize that accumulation of the developer on the charge member is not a problem in the repetition of the normal image forming process, a problem may arise. For example, when the transfer material is jammed during output of the image, and the image forming operation is resumed with the developed image remains of the image bearing member, a great amount of the developer is deposited directly on the charge member in a cleanerless system. If such occurs repeatedly, the insufficiency of the charging power and the contamination of the transfer material and the disturbance to the latent image result.

SUMMARY OF THE INVENTION

Accordingly, it is a principal object of the present invention to provide an image forming apparatus in which the charge member is efficiently cleaned.

It is another object of the present invention to provide an image forming apparatus in which an image defect attributable to the developer deposited to the charge member is avoided.

It is a further object of the present invention to provide an image forming apparatus in which the charging power of the charge member is maintained stable for a long period of time.

It is a further object of the present invention to provide an image forming apparatus in which charge member is suitable for injection charging of the image bearing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

<First Embodiment> (FIGS. 1–4)

Figure 1:
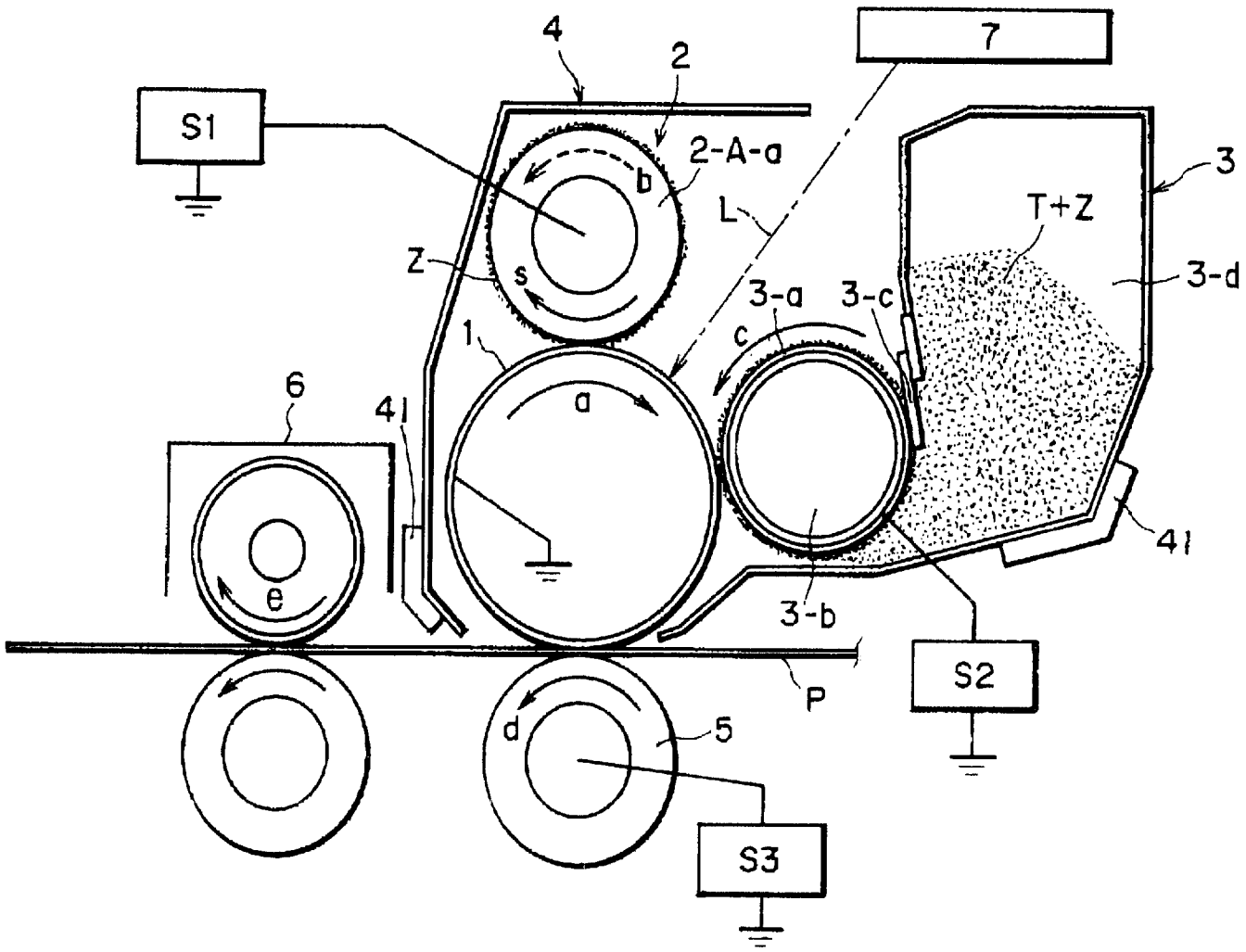
FIG. 1 is a rough vertical sectional view of the image forming apparatus in the first embodiment, for depicting the structure thereof.

FIG. 1 is a rough vertical view of an example of an image forming apparatus in accordance with the present invention. The image forming apparatus in this embodiment is a cleaner-less laser beam printer, which employs a transfer type electrophotographic process, an injection type charging method which uses charge enhancement particles, a reversal type developing method, and a process cartridge system.

(1) General Structure of Printer

A referential code 1 designates a rotational drum type electrophotographic photosensitive member (which hereinafter will be referred to as "photosensitive drum") as an image bearing member. The photosensitive drum is, for example, an OPC type photosensitive drum, and is rotationally driven at a predetermined peripheral velocity (process speed) in the direction indicated by an arrow mark a.

Figure 9:
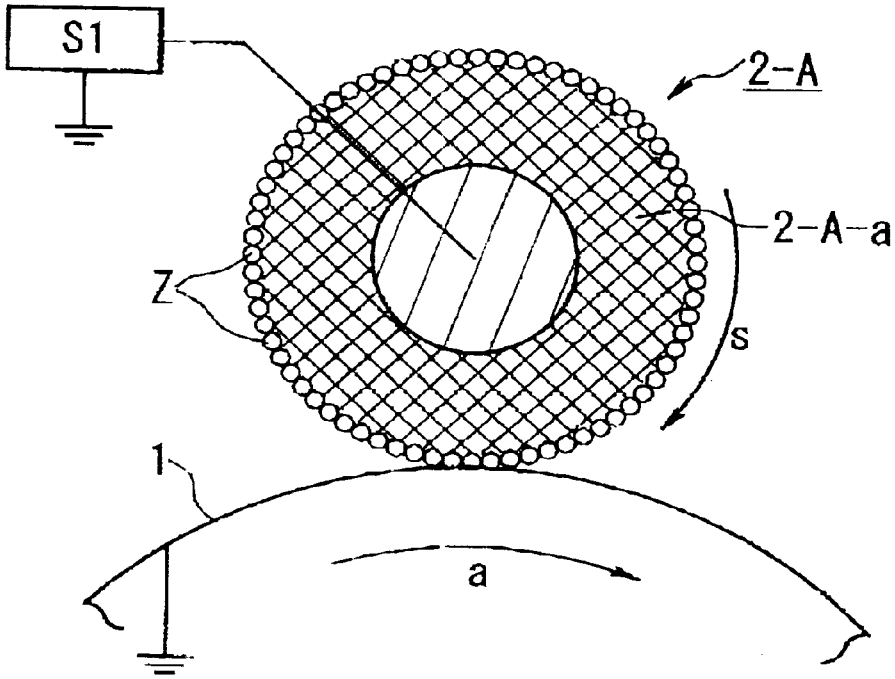
FIG. 9 is a rough vertical view of a sponge roller type charging apparatus.

A referential code 2 designates a charging apparatus for injecting electrical charge into the photosensitive drum 1 to uniformly charge the peripheral surface of the photosensitive drum 1 to predetermined polarity and potential level In this embodiment, the charging apparatus is a sponge roller type charging apparatus such as the above described one shown in FIG. 9, which comprises a sponge charge roller 2-A-*a*, as a contact type charging member, coated with electrically conductive particles Z. The peripheral surface of the photosensitive drum 1 is uniformly charged to −600 V (dark potential Vd) through the charge injection by the sponge charge roller 2-A-*a*. This charging apparatus 2 will be described in detail in Section (3).

Designated by a referential code 7 is a laser beam scanner as an information writing means. This scanner 7 comprises a laser diode, a polygon mirror, and the like, and emits a beam of laser light L modulated in intensity with serial digital electrical image signals of image formation data inputted from an unshown host apparatus such as a computer, in a manner to scan the uniformly charged peripheral surface of the photosensitive drum 1. As the uniformly charged surface of the peripheral surface of the photosensitive drum 1 is exposed to the scanning beam of laser light L, the electrical potential of the exposed portions of the peripheral surface of the photosensitive drum 1 reduces. As a result, difference in electrical potential is created between the exposed and unexposed portions of the peripheral surface of the photosensitive drum 1; in other words, an electrostatic latent image which reflects the exposure pattern is formed on the peripheral surface of the photosensitive drum 1. In this embodiment, the electrical potential of the exposed portions of the peripheral surface of the photosensitive drum 1, that is, so-called light potential Vl, is −150 V (Vl=−150 V). In comparison, the electrical potential of the unexposed portions of the peripheral surface of the photosensitive drum 1, that is, so-called dark potential Vd, is −600 V (Vd −600 V).

Designated by a referential code 3 is a developing apparatus. In this embodiment, it is a reversal type developing apparatus which employs a so-called jumping developing method in which the developer layer on a developing member does not contact the photosensitive drum 1. In development, an electrostatic latent image Is developed in reverse; negative toner as developer adheres to the light potential portions of the peripheral surface of the photosensitive drum 1. This developing apparatus will be described in detail in Section (4).

A referential code 5 designates a transfer roller as a contact type transferring means, the electrical resistance of which is in the medium range. It is kept pressed upon the photosensitive drum 1, forming a transfer nip. It rotates at approximately the same peripheral velocity as that of the photosensitive drum 1 in the direction indicated by an arrow mark d, which is the same as the rotational direction a of the photosensitive drum 1. In a transfer process, a transfer medium P (transfer paper) is delivered with a predetermined control timing to the transfer nip from an unshown sheet feeding stations while a predetermined transfer bias voltage, which is reverse in polarity to toner, for example, +2 kV, is applied to the transfer roller 5 from an electrical power source S3. As a result, the toner image on the peripheral surface of the photosensitive drum 1 is continuously electrostatically transferred onto the surface of the transfer medium P, in the transfer nip.

A referential code 6 designates a fixing apparatus which employs a thermal fixing method or the like. After having been fed into the transfer nip and received the toner image in the transfer nip, the transfer medium P is separated from the peripheral surface of the photosensitive drum 1, and is introduced into the fixing apparatus 6, in which the toner image is fixed to the transfer medium P.

Thereafter, the transfer medium P is discharged, as a so-called print or copy, from the apparatus main assembly.

The printer in this embodiment is a cleaner-less printer, in which the transfer residual toner, that is, the toner remaining on the peripheral surface of the rotational photosensitive drum 1 after the transfer of the toner image onto the transfer medium P in the transfer nip, is not immediately removed by a cleaner (cleaning apparatus) dedicated to cleaning, after the transfer, and remains borne on the peripheral surface of the photosensitive drum 1. Then, as the photosensitive drum 1 further rotates, the residual toner passes by the charging apparatus 2 and reaches the development station, in which it is recovered, that is, removed, at the same time as the electrostatic latent image formed in the following rotational cycle of the photosensitive drum 1 is developed by the developing apparatus 3. The recovered residual toner is reused. This cleaner-less system will be described in detail in Section (5).

The printer in this embodiment employs a process cartridge 4, which is removably mountable in the main assembly of the printer, and in which three processing devices, that is, the photosensitive drum 1, sponge charge roller 2-A-*a*, and developing apparatus 3, are integrally disposed. Designated by referential codes 41 are cartridge guiding/holding members on the printer main assembly side.

A minimum requirement for a cartridge to be a process cartridge is that the cartridge is removably mountable in the main assembly of the image forming apparatus, and a minimum of one means among a charging means a developing means and a cleaning means is integrally disposed in.

(2) Operational Sequence of Printer

Figure 2:
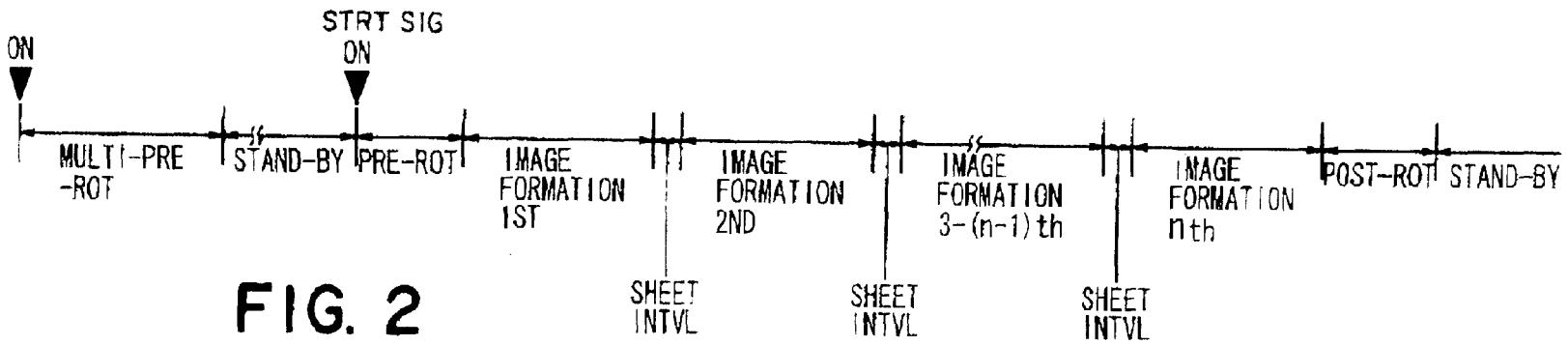
FIG. 2 is a diagram of the operational sequence of the image forming apparatus.

FIG. 2 is a diagram of the operational sequence of the above described printer.

a. Multiple Pre-rotation Process (Startup Rotation)

This is a process carried out immediately after the printer is started, that is, a process carried out during the startup period (startup operation period, warmup period). As an electric power switch is turned on, processes for preparing predetermined processing devices are carried out; for example, the photosensitive drum begins to be rotated, and the temperature of the fixing apparatus is increased to a predetermined level.

b. Image Formation Pre-rotation Process (Printing Preparation Rotation)

This is a process carried out during the image formation preparation rotation period, that is, the period from the moment an image formation signal (print signal) is inputted to the moment an actual image formation process (printing) begins. If an image formation start signal is inputted during the above described multiple pre-rotation process, this image formation pre-rotation process is carried out immediately following the multiple pre-rotation process. When no image formation start signal is inputted, the driving of the main motor is temporarily stopped to stop the rotational driving of the photosensitive drum, after the multiple pre-rotation process, and then, the printer is kept on standby until a print signal is inputted. Thereafter, image formation pre-rotation is carried out as an image formation signal is inputted.

c. Image Formation Process (Printing Process)

This is a process which is carried out following the completion of predetermined image formation pre-rotation process, and in which a toner image is formed on the rotational photosensitive drum; the toner image on the peripheral surface of the rotational photosensitive drum is transferred onto a transfer medium; the toner image on the transfer medium is fixed by the fixing apparatus; and the transfer medium onto which the toner image has been fixed is discharged as a print from the apparatus main assembly.

In a continuous image formation mode (continuous printing, consecutive printing), the above described image formation process is repeated a number of times equal to a preset number (n) of prints.

d. Sheet Interval Process

This is a process carried out during a sheet interval, that is, an interval from the moment the trailing end of the preceding recording medium leaves the transfer station to the moment the leading end of the following transfer medium reaches the transfer station, that is, a period during which no transfer medium passes through the transfer station (period which corresponds to the range of the peripheral surface of the photosensitive drum where no image is formed).

e. Post-rotation Process

This is a process which is carried out following the completion of the image formation on the last transfer medium, and in which the driving of the main motor is continued for a while to rotationally drive the photosensitive drum, and predetermined post-image formation operations are carried out.

f. Standby Process

This is a process which follows the completion of the predetermined post-rotation process, and in which the driving of the main motor is stopped to stop the rotational driving of the photosensitive drum, and the printer is kept an standby until the next image formation start signal Is inputted.

When only a single print is made, the printer is entered into the standby state after being put through the post-rotation process.

As an image formation start signal is inputted when the printer is on standby, the printer begins the pre-rotation process.

(3) Charging Apparatus 2

The charging apparatus 2 in this embodiment is an injection type charging apparatus and employs a sponge roller as a contact type charging member. The sponge charge roller 2-A-*a* as a contact type charging member is an electrically conductive roller having a hardness of 30 degrees and an average foam diameter of 50 $\mu$m. It is covered with electrically conductive particles Z around its peripheral surface, and is kept pressed upon the photosensitive drum 1 with the application of a predetermined pressure. It is rotationally driven in the direction indicated by an arrow mark s by an unshown driving system, so that the direction of the movement of its peripheral surface in the charge nip, that is, the interface between the sponge charge roller and photosensitive drum 1, becomes opposite to that of the photosensitive drum 1. The peripheral velocity of the sponge charge roller 2-A-*a* during an image forming operation is 1.5 times that of the photosensitive drum 1; in other words, in terms of relative peripheral velocity, there is a peripheral velocity difference of 25% between the sponge charge roller 2-A-*a* and photosensitive drum 1. Further, a predetermined charge bias voltage is applied to the sponge charge roller 2-A-*a* from an electrical power source S1.

As for the electrically conductive particles Z, electrically conductive zinc oxide particles, which are 3 $\mu$m in average particle diameter inclusive of secondary particles (aggregates), and $10^6$ ohm.cm in specific resistance, are used. The charge polarity of these electrically conductive particles is positive; in other words it is opposite to that of the toner T, that is, developer, which is negative. The electrically conductive particles Z adhere to the peripheral surface of the sponge charge roller 2-A-*a*, essentially, across the areas with the microscopic recesses, covering the peripheral surface of the sponge charge roller 2-A-*a*. As a result, electrically conductive particles Z are interposed between the sponge charge roller 2-A-*a* and photosensitive drum 1, in the charge nip, that is, the interface between the sponge charge roller 2-A-*a* and photosensitive drum 1.

The electrically conductive particles Z are microscopic particles employed to enhance the charging performance of the sponge charge roller 2-A-*a*. The interposition of the electrically conductive particles Z between the sponge charge roller 2-A-*a* and photosensitive drum 1 in the charging nip brings forth the following benefits. It reduces the friction between the sponge charge roller 2-A-*a* and photosensitive drum 1, which makes it possible to reduce the torque necessary to rotate the sponge charge roller 2-A-*a*, and makes it easier for the sponge charge roller 2-A-*a* to be kept in contact with the photosensitive drum 1 while maintaining a difference in peripheral velocity between the sponge charge roller 2-A-*a* and photosensitive drum 1. Further, the interposition of the electrically conductive particles Z assures that the electrically conductive particles Z fill the microscopic gaps between the sponge charge roller 2-A-*a* and photosensitive drum 1 in the charge nip, making the electrical contact between the sponge charge roller 2-A-*a* and photosensitive drum 1 uniformly across the entirety of the charging nip. In other words, the electrically conductive particles Z rub the peripheral surface of the photosensitive drum 1 without missing any spot, in the charging nip. Thus, even when a simple charging member such as a charge roller or the like is employed, the photosensitive drum 1 can be charged essentially through direct charge injection, which requires the application of relatively low voltage, and produces virtually no ozone. Further, the photosensitive drum 1 is uniformly charged even in microscopic terms.

As described above, in principle, a charge injection system does not rely on electrical discharge. Thus, in order to charge an image bearing member, that is, an object to be charged, with the use of a charge injection system, electrical charge is directly injected into the image bearing member from a charging member. In this system, even if the voltage applied to the charging member to charge the image bearing member is lower than the discharge threshold voltage, the image bearing member can be charged to the potential level approximately equal to the potential level of the voltage applied to the charging member. Therefore, it does not occur that ions are generated by electrical discharge. Thus, there is no problems related to the substances resulting from electrical discharge.

In this embodiment, a charge bias voltage of −610 V is applied to the sponge charge roller 2-A-*a* by the electrical power source S1 Therefore, in the area in which the photosensitive drum 1 and sponge charge roller 2-A-*a* make contact with each other, that is, the area in which the electrically conductive particles Z come directly in contact with the photosensitive drum 1 and sponge charge roller 2-A-*a*, there is a tendency for them to be induced to become equal in potential level, In other words, electrical charge is induced on the peripheral surface of the photosensitive drum 1, increasing the potential level of the peripheral surface of the photosensitive drum 1 to −610 V, which is the same as that of the sponge charge roller 2-A-*a*.

Shifts in electrical charge similar to the above described one also occur when the peripheral surfaces of the sponge charge roller 2-A-*a* and photosensitive drum 1 are separated from each other. In the latter case, the potential level of the peripheral surface of the photosensitive drum 1 decreases, and the amount by which it decreases is determined by the values of the electrical resistance of the sponge charge roller 2-A-*a*, electrically conductive particles Z, and photosensitive drum 1, and the manner in which the functional layers of the photosensitive drum 1 are arranged. In this embodiment, this decrease in the potential level of the peripheral surface of the photosensitive drum 1 is held to 10 V by realizing a charging system which is capable of minimizing the decrease. As a result, the surface potential level (dark area potential Vd) of −600 V is realized.

As for the material for the electrically conductive particles Z, various electrically conductive particles are usable. For example, various metallic oxide particles in addition to zinc oxide particles, and a mixture of metallic oxide particles and organic particles, may be used. In order to realize uniformity in charge, the electrically conductive particles Z are desired to be no more than 50 $\mu$m, preferably, 10 $\mu$m, in diameter. It seems that the smallest diameter with which the electrically conductive particles Z remain stable is 10 nm. Further, since electrical charge is transferred through the electrically conductive particles Z, the specific resistivity of the electrically conductive particles Z is desired to be no more than $10^{12}$ ohm.cm, preferably, $10^{10}$ ohm.cm. The state of the electrically conductive particles Z do not matter; it may be in the primary state, or the secondary state, that is, the aggregated state.

(4) Developing Apparatus 3

In this embodiment, the developing apparatus 3 is a developing apparatus which employs a so-called jumping developing method in which a developing member does not contact the photosensitive drum 1. It is a reversely developing apparatus which uses negatively chargeable magnetic single component toner as developer T. The developer T (which hereinafter will be referred to as "toner") stored in the developer container is a mixture of the aforementioned magnetic single component toner, and a predetermined amount of the electrically conductive particles Z added or mixed into the toner, so that the electrically conductive particles Z are supplied to the sponge charge roller 2-A-*a* of the charging apparatus 2 from the developing apparatus 3.

Designated by a referential code 3-*a* is a development sleeve formed of nonmagnetic material; 3-*b*, a development magnet contained in the hollow of the development sleeve; 3-*c*, a development blade placed in contact with the development sleeve; and designated by a referential code 3-*d* is a developer container. The development sleeve 3-*a* is disposed in a manner to oppose the photosensitive drum 1 while holding a gap of 300 $\mu$m from the photosensitive drum 1. The location at which the development sleeve 3-*a* and photosensitive drum 11 oppose each other is the development station. The development sleeve 3-*a* is rotated at a predetermined peripheral velocity, in the direction indicated by an arrow mark c so that the directions in which the peripheral surfaces of the development sleeve 3-*a* and photosensitive drum 1 move in the development station coincide. The development magnet 3-*b* is stationary and is nonrotationally disposed. Within the developer container 3-*d*, a mixture of the magnetic toner T as developer, and the electrically conductive particles Z, is stored. In this embodiment, two parts in weight of electrically conductive particles Z are mixed into one part in weight of the toner T. Unless the electrically conductive particles Z are affected by strong electrical force, they mostly adhere to toner T and move with the toner T.

The peripheral surface of the development sleeve 3-*a* is rendered coarse to improve the development sleeve 3-*a* in toner retention. The development sleeve 3-*a* bears the magnetic toner T, which contains the electrically conductive particles Z, on its coarse surface, in cooperation with the magnetic force of the development magnet 3-*b* within the development sleeve 3-*a*, and conveys the toner T in the direction of the arrow mark c. As the layer of toner T held to the peripheral surface of the development sleeve 3-*a* passes under the development blade 3-*c*, in contact with the development blade 3-*c*, the layer of the toner T is regulated in thickness, and is charged by friction. The polarity to which the toner T is charged is determined by the polarity to which the material for the toner T is chargeable. In this embodiment, the most of the toner T particles are negatively charged. On the contrary, the electrically conductive particles Z is positively charged while they pass the same location.

After passing under the development blade 3-*c*, the toner T and electrically conductive particles Z are further conveyed to the development station by the rotation of the development sleeve 3-*a*. To the development sleeve 3-*a*, a predetermined development bias, which is a combination of DC voltage and AC voltage, is being applied from an electrical power source S2. Therefore, the toner particles in the layer of the toner T borne on the development sleeve 3-*a* jump from the development sleeve 3-*a* side to the photosensitive drum 1 side, adhering to the peripheral surface of the photosensitive drum 1 in a selective manner, that is, in a manner to reflect the pattern of the electrostatic latent image, in the development station, in which the layer of the toner T does not contact the photosensitive drum 1 In other words, the electrostatic latent image is developed in reverse in the development station. Also, the electrically conductive particles Z transfer from the development sleeve 3-*a* side to the photosensitive drum 1 side, and adhere to the peripheral surface of the photosensitive drum 1. The toner T and electrically conductive particles Z which have remained on the development sleeve 3-*a* are returned to the location at which the toner T is coated, to be recycled, by the rotation of the development sleeve 3-*a*.

Figure 3:
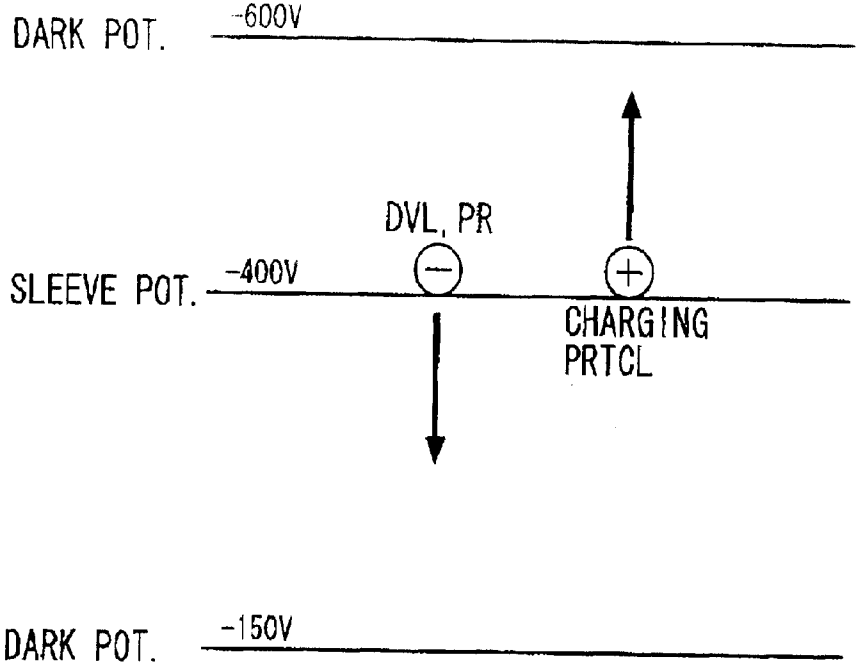
FIG. 3 is a drawing for depicting the behavior of the developer (toner) particles and electrically conductive particles in the development station.

At this time, referring to FIG. 3, how the charged toner T and electrically conductive particles Z behave in the space (gap) between the development sleeve 3-*a* and photosensitive drum 1, that is, the development station, will be described.

As the above described negatively charged toner T enters the adjacencies of the photosensitive drum 1, it is made to develop the electrostatic latent image by the electric field formed between the photosensitive drum 1 and development sleeve 3-*a*. In this embodiment, development bias, which is a combination of a DC voltage of −400 V and an AC voltage which is rectangular in wave-form, 1,500 Hz in frequency, and 1,600 V in peak-to-peak voltage relative to the photosensitive drum 1, is being applied to the development sleeve 3-*a*, by the electrical power source S2. Therefore, the negatively charged toner T particles jump to the light potential areas, that is, the areas with a potential level of −150 V (Vl=150 V), of the peripheral surface of the photosensitive drum 1, across the 300 $\mu$m gap between the photosensitive drum 1 and development sleeve 3-*a*, without jumping to the dark potential area, that is, the area with a potential level of −600 V (Vd=−600 V).

During this jumping of the toner T particles, it is possible, in electrical terms, for the electrically conductive particles Z, which are carrying positive charge, to jump to the dark potential areas, unlike the toner T particles. However, most of them remain adhered to the toner T particles due to their size; as long as electrostatic attraction between the toner T particles and electrically conductive particles Z is stronger than the electrostatic attraction between the electrically conductive particles Z and dark potential areas, the electrically conductive particles Z behave in the same manner as the toner T particles. In other words, it is possible for the electrically conductive particles Z to jump to both the light and dark potential areas of the peripheral surface of the photosensitive drum 1.

(5) Cleaner-less System, and Supply of Electrically Conductive Particles Z to Sponge Charge Roller The toner T particles which have transferred onto the photosensitive drum 1 through the development process are transferred onto the transfer medium P through the transfer process. More specifically, to the transfer roller of the transferring apparatus 5, a DC voltage of 2 kV relative to the photosensitive drum 1 is applied as transfer bias, creating an electrical field between the photosensitive drum 1 and transfer roller 5. As a result, the negatively charged toner T particles are attracted toward the transfer roller 5, and therefore, most of the toner T particles are transferred onto the transfer medium P.

On the other hand, most of the electrically conductive particles Z which have transferred onto the light potential areas along with the toner T particles transfer to the transfer medium P together with the toner T particles. However, in electrical terms, the electrically conductive particles Z are more stable in their status when they are on the photosensitive drum 1, and therefore, a larger amount of the electrically conductive particles Z remain on the photosensitive drum 1 compared to the toner T. Most of the electrically conductive particles Z which have transferred onto the dark potential areas remain on the photosensitive drum 1.

After the completion of the transfer process, a small amount of the toner T particles which remained on the light potential areas, and a relatively large amount of the electrically conductive particles Z which remained across the entirety of the peripheral surface of the photosensitive drum 1, coexist on the peripheral surface of the photosensitive drum 1.

Because the printer in this embodiment is of a cleaner-less type, these toner T particles and electrically conductive particles Z which remained on the photosensitive drum 1 after the transfer process are carried by the further rotation of the photosensitive drum 1, to the charge nip, that is, the interface between the sponge charge roller 2-A-*a* of the charging apparatus 2 and the photosensitive drum 1.

In the charge nip, a voltage of −610 V relative to the photosensitive drum 1 is being applied to the sponge charge roller 2-A-*a*. Therefore, the electrically conductive particles Z, which have been positively charged, transfer to sponge charge roller 2-A-*a* from the peripheral surface of the photosensitive drum 1, which has been charged to the positive side, relative to the sponge charge roller 2-A-*a*, through the transfer process, and are held by the peripheral surface of the sponge charge roller 2-A-*a*, which is full of microscopic pores of the sponge, enhancing the charging performance of the sponge charge roller 2-A-*a* as described before. In other words, the electrically conductive particles Z which remain on the photosensitive drum 1 after the transfer process are supplied to the sponge charge roller 2-A-*a*, by the developing apparatus 3.

On the other hand, most of the toner T particles which failed to be transferred from the photosensitive drum 1, that is, the toner T particles which remained on the photosensitive drum 1, are either such toner T particles that had been positively charged, and are difficult to transfer, or such toner T particles that were positively charged by being subjected to the transfer voltage. These toner T particles adhere to the sponge charge roller 2-A-*a* because of their positive potential. After adhering to the sponge charge roller 2-A-*a*, they remain on the sponge charge roller 2-A-*a*, and as the sponge charge roller 2-A-*a* rotates, they are charged to the negative polarity, that is, the normal polarity, while they go several times through the area in which the photosensitive drum 1 is charged by the sponge charge roller 2-A-*a* as the sponge charge roller 2-A-*a* rotates. Since the toner T is easily chargeable to the negative polarity by nature, it is relatively quickly charged to the negative polarity. After being charged to the negative polarity on the sponge charge roller 2-A-*a*, most of the toner T particles on the sponge charge roller 2-A-*a* return to the photosensitive drum 1 from the sponge charge roller 2-A-*a*, and are carried to the development station by the further rotation of the photosensitive drum 1. In the development station in which the development process is carried out, the toner T particles are recovered by the developing apparatus 3 while they are passing the area in which the peripheral surface of the photosensitive drum 1 comes virtually in contact with the development sleeve 3-*a*, then, they are assimilated by the toner T particles in the developing apparatus 3, and are used for development.

In the method in which an image bearing member is cleaned at the same time as a latent image on the photosensitive drum 1 is developed, the toner T particles remaining on the image bearing member after image transfer are removed during the development process carried out during the following rotation of the image bearing member. More specifically, in the following rotation of the image bearing member, the image bearing member is again charged, and a latent image is formed. Then, the toner T particles remaining on the image bearing member are recovered by the fog prevention bias Vback (difference in potential level between the DC voltage applied to the developing apparatus and the voltage of the peripheral surface of the image bearing member). In this method, the transfer residual toner is recovered by the developing apparatus and is used in the following image formation processes. Therefore, the toner T is not wasted; there is no waste toner. Consequently, one of the maintenance chores is eliminated. Further, being cleanerless is advantageous from the standpoint of spatial efficiency, because it makes it possible to reduce an image forming apparatus in size.

(6) Sponge Charging Roller Cleaning Mode

As described before, in order to assure that an injection type charging apparatus is excellent in charging performance, the injection site between the charging member of the charging apparatus and an image bearing member must be kept in a condition in which charge is efficiently injected, and this condition must be maintained for a long period of time. However, under certain conditions, toner sometimes adheres to the charging member by an amount large enough to cause an image forming apparatus to produce a detective image.

Thus, in this embodiment, in order to effectively clean the charging member of the injection type charging system employed as a means for charging the image bearing member, by the image forming apparatus, without affecting the image formation, so that the charging performance of the charging member is kept stable at an excellent level to prevent the image forming apparatus from being caused to produce a defective image by the adhesion of an excessive amount of toner to the charging member, a sponge charge roller cleaning mode is provided, in which the toner particles adhering to the sponge charge roller 2-A-*a* are forcefully ejected onto the photosensitive drum 1 as an image bearing member, and are recovered by the developing apparatus 3 from the photosensitive drum 1.

More specifically, in the sponge charge roller cleaning mode, the rotational direction of the sponge charge roller 2-A-*a* which is driven in the direction indicated by the arrow mark a, that is, the direction counter to the rotational direction of the photosensitive drum 1, in which the sponge charge roller 2-A-*a* is normally rotated during image formation, is allowed to follow the rotation of the photosensitive drum 1 and rotate in the direction indicated by an arrow mark b, that is, the same direction as the rotational direction of the photosensitive drum 1, and a bias of −600 V is applied to the sponge charge roller 2-A-*a* is applied as the sponge charge roller 2-A-*a* is rotated in the counter direction indicated by the arrow mark s. In addition, bias similar to the normal development bias is applied to the developing apparatus 3 at the same time.

In this embodiment, the switching between the driven rotation and following rotation of the sponge charge roller 2-A-*a* is made with the use of a clutch placed in the drive trains (unshown) of the sponge charge roller 2-A-*a*. The clutch is turned on or off by a control circuit, with a predetermined control timing. As the clutch is turned on, the clutch is connected and the sponge charge roller 2-A-*a* is rotationally driven, whereas as the clutch is turned off, the clutch is disconnected, and the sponge charge roller 2-A-*a* is allowed to freely rotate, following the rotation of the photosensitive drum 1. While the sponge charge roller 2-A-*a* is following the rotation of the photosensitive drum 1, the difference in peripheral velocity between the two is virtually zero.

As the image forming apparatus is operated in the above described cleaning mode, the toner particles adhering to the sponge charge roller 2-A-*a* are extremely efficiently discharged onto the photosensitive drum 1, and are recovered into the developing apparatus 3 by the development bias, in the development station.

Table 1 given below shows the results of an experiment regarding the relationship among the rotation of a sponge charge roller, bias applied to the sponge charge roller, and the amount of the toner discharged from a sponge charge roller, in which the sponge charge roller 2-A-*a* to which a large amount of developer toner had adhered was used.

TABLE 1

| | Rotationally driven (peripheral velocity ratio: 250%) | Following rotation of drum (peripheral velocity ratio: 0%) |
|---|---|---|
| Charge bias is on | 2.0% | 18.3% |
| Charge bias is off | 2.9% | 3.6% |

In this experiment, the amount of the toner which remained on the photosensitive drum 1 after passing the interface between the photosensitive drum 1 and sponge charge roller was measured by taping, under four different conditions created by combining two state of charge bias (on and off) with two different peripheral velocity ratios: a peripheral velocity difference of 250%, which is created when the sponge charge roller is rotated in the same manner as it is rotated in the above described charging process, and a peripheral velocity difference of virtually 0%, which is created when the sponge charging roller is allowed to freely rotate following the rotation of the photosensitive drum. Under each condition, virtually the same amount of toner was intentionally adhered to the sponge charge roller.

The values in Table 1 represent the ratios of the black areas, which indicate the presence of toner T, obtained by binarization.

As shown in Table 1, the condition in which bias is applied while allowing the sponge charge roller to follow the rotation of the photosensitive drum 1 shows a large value, evidencing that toner is easy to discharge from a sponge charge roller under this condition.

It is reasonable to think that the experiment demonstrated the results as shown in Table 1 for the following reasons. The difference between when difference in peripheral velocity was provided between the sponge charge roller and photosensitive drum 1, and when the difference was not provided, that is, when the sponge charge roller was allowed to follow the rotation of the photosensitive drum 1, was created because, when the difference in peripheral velocity was provided, the effect that the sponge charge roller scraped the toner on the peripheral surface 1 away from the photosensitive drum 1 increased, and therefore, it was easier for the sponge charge roller to discharge the toner when the difference was not provided.

Regarding the difference created between when voltage was applied and when it is not, it is reasonable to think that not only was the toner charged by the voltage application, but also difference in potential level was created between the sponge charge roller 2-A-*a* and photosensitive drum 1, effecting electrical force which caused the toner to transfer onto the photosensitive drum 1.

Figure 4:
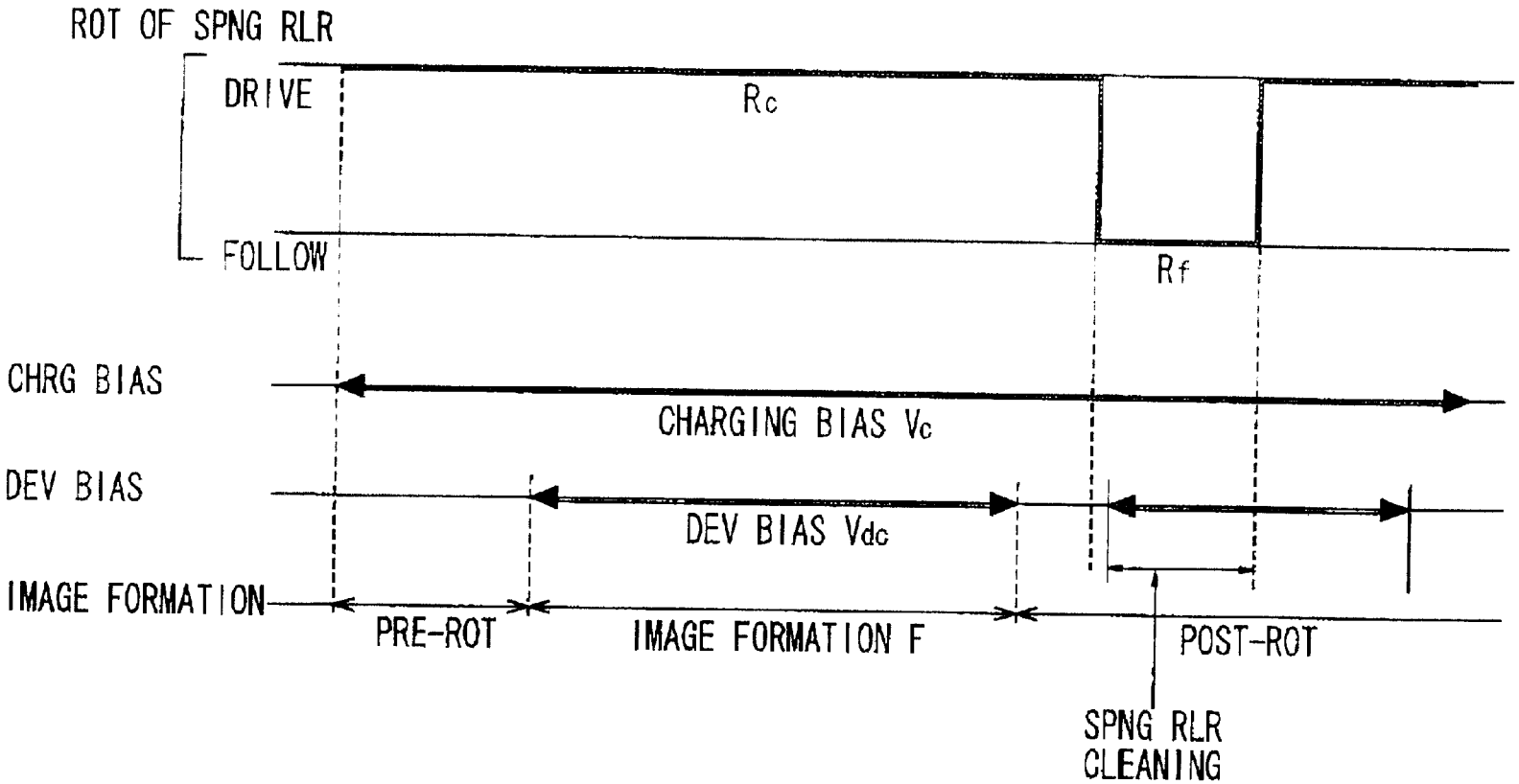
FIG. 4 is a diagram of the sponge charge roller cleaning sequence.

FIG. 4 is a rough diagram for showing the charging and developing sequences in this embodiment. In this embodiment, the above described sponge charge roller cleaning sequence is carried out during the post-rotation process in the image formation sequence. More specifically, the rotation of the sponge charge roller 2-A-*a* is switched from the driven rotation Rc to following rotation Rf, while continuing the application of a charge bias Vc, during the post-rotation process which comes after a period F in which an image is formed on the photosensitive drum 1. Then, immediately after the switching of the rotation of the sponge charge roller 2-A-*a*, the application of a development bias Vdc is started to force the toner on the sponge charge roller 2-A-*a* which is following the rotation of the photosensitive drum 1, to be discharged onto the photosensitive drum 1 so that the toner is recovered by the developing apparatus 3.

In this sequence, the rotation of the sponge charge roller 2-A-*a* is switched back from the following rotation Rf to the driven rotation Rc, slightly earlier than when the development bias Vdc is turned off, for the following reason. That is, if the amount of the toner discharged from the sponge charge roller 2-A-*a* is greater than the amount of the toner recoverable by the developing apparatus 3, it adversely affects the image which will be formed during the following rotational cycle of the photosensitive drum 1. Therefore, it must be assured that the amount of the toner discharged from the sponge charge roller 2-A-*a* is smaller than the amount of the toner recoverable by the developing apparatus 3.

In order to test the effectiveness of the above described cleaning mode, 10,000 copies were continuously outputted, while carrying out the cleaning mode every 10 copies. Even after the outputting of 10,000 copies, no image defect such as those which result from the contamination of the peripheral surface of the sponge charge roller 2-A-*a* could be found. Further, there was no drop in the potential level to which the photosensitive drum 1 was charged; the charging performance of the sponge charge roller remained stable.

Further, when the sponge charge roller 2-A-*a* in accordance with the present invention was used, the amount of the toner which remained adhered to the sponge charge roller 2-A-*a* was clearly smaller than when a sponge charge roller which was not in accordance with the present invention was used.

In other words, the present invention made it possible to stabilize the charging performance of the sponge charge roller 2-A-*a* by minimizing the amount of the toner which remained adhered to the sponge charge roller 2-A-*a*. Therefore, it became possible to make an image forming apparatus to continuously produce high quality Images for a long period of time.

Figure 7:
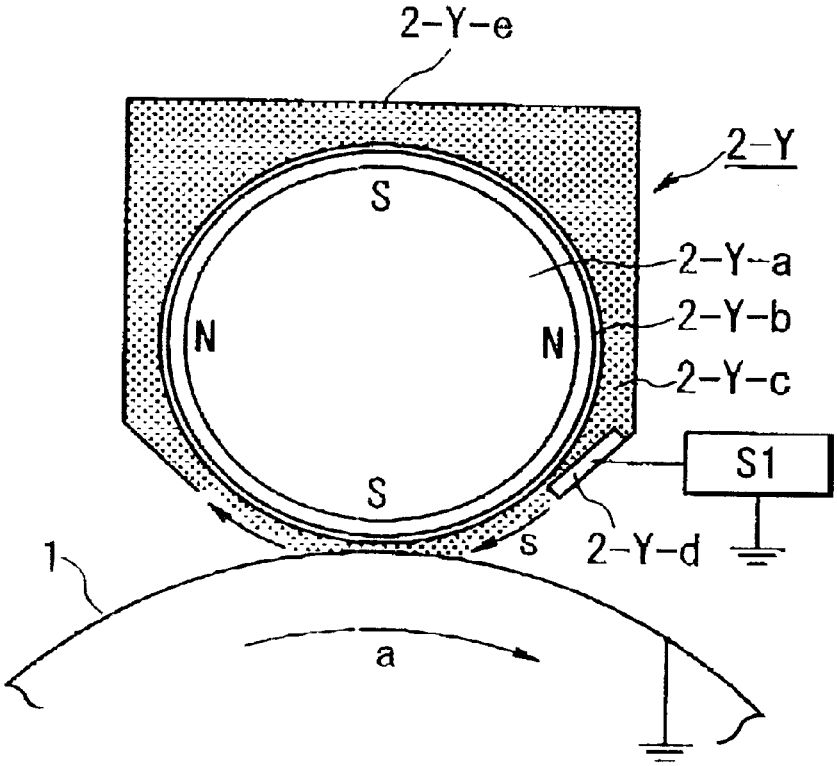
FIG. 7 is a rough vertical view of a magnetic brush type charging apparatus.
Figure 8:
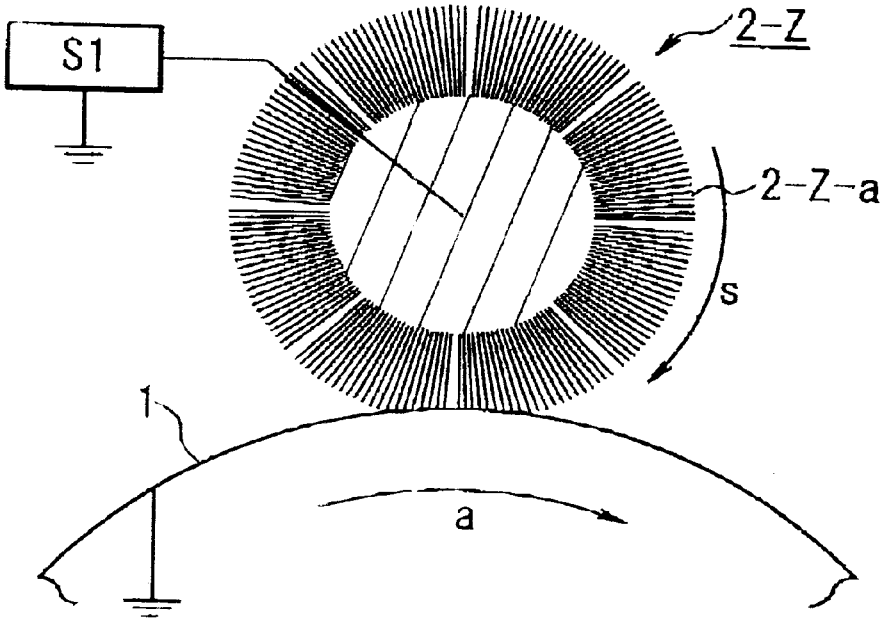
FIG. 8 is a rough vertical view of a fur brush type charging apparatus.

Incidentally, in this embodiment of the present invention, the injection type charging system was described with reference to a charging system which employed the sponge charge roller 2-A-*a* and electrically conductive particles Z. However, the present invention is also applicable to a magnetic brush based charging system (FIG. 7), or a fur brush based charging system (FIG. 8), which was described as examples of the conventional charging system, for the following reason. That is, the magnetic brush or fur brush based charging system is the same as the sponge charge roller based charging system in that, because the charging member is placed in contact with the photosensitive drum 1 and is rotated in the direction counter to the rotational direction of the photosensitive drum 1, the toner is likely to be recovered by the charging apparatus from the peripheral surface of the photosensitive drum 1 in the normal process. Therefore, the provision of a process in which the difference in peripheral velocity between the charging member and photosensitive drum 1 is eliminated, and charge bias is applied to the charging member while there is virtually no difference in peripheral velocity between the charging member and the photosensitive drum 1, makes it possible for the toner to be discharged from the charge roller to the peripheral surface of the photosensitive drum 1.

Further, in the cleaning sequence in this embodiment, the difference in peripheral velocity between the sponge charge roller 2-A-*a* and photosensitive drum 1 is decreased to virtually zero by allowing the sponge charge roller 2-A-*a* to be rotated by the rotation of the photosensitive drum 1. This is due to the fact that when the sponge charge roller 2-A-*a* is used as a charging member, the mechanism for making the charging member follow the rotation of the photosensitive drum 1 is simple, and the peripheral velocity of the charging member relative to that of the photosensitive drum becomes virtually zero, or the smallest, whereas when the magnetic brush or fur brush is used as a charging member, it is difficult for the charging member to follow the rotation of the photosensitive drum 1, admitting that the charging member can be driven in a manner to reduce to virtually zero, the peripheral velocity of the charging member relative to that of the photosensitive drum 1 in order to obtain the same effects as obtained when the sponge charge roller 2-A-*a* is employed.

Figure 5:
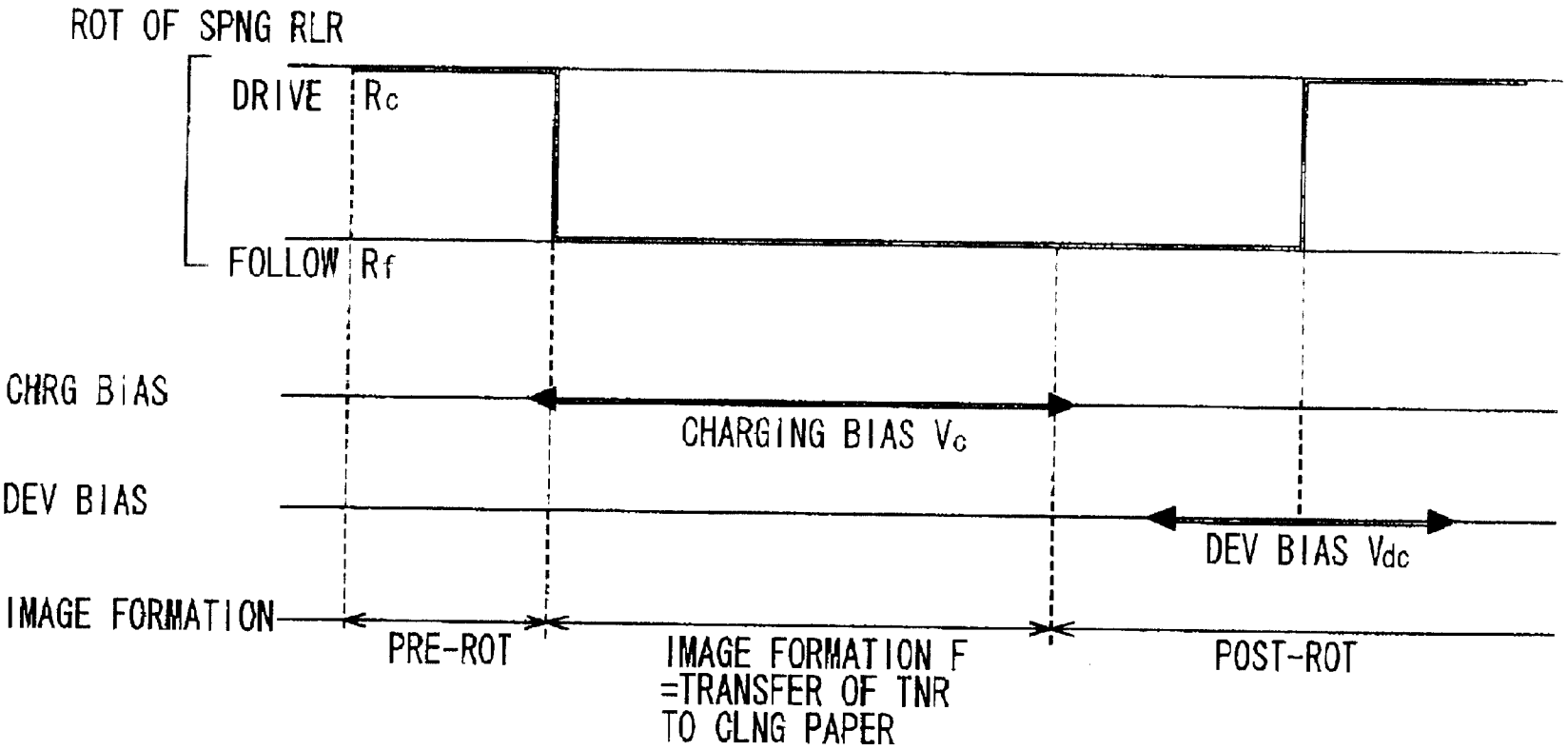
FIG. 5 is a diagram of the sponge charge roller cleaning sequence of the image forming apparatus in the second embodiment.
Figure 6:
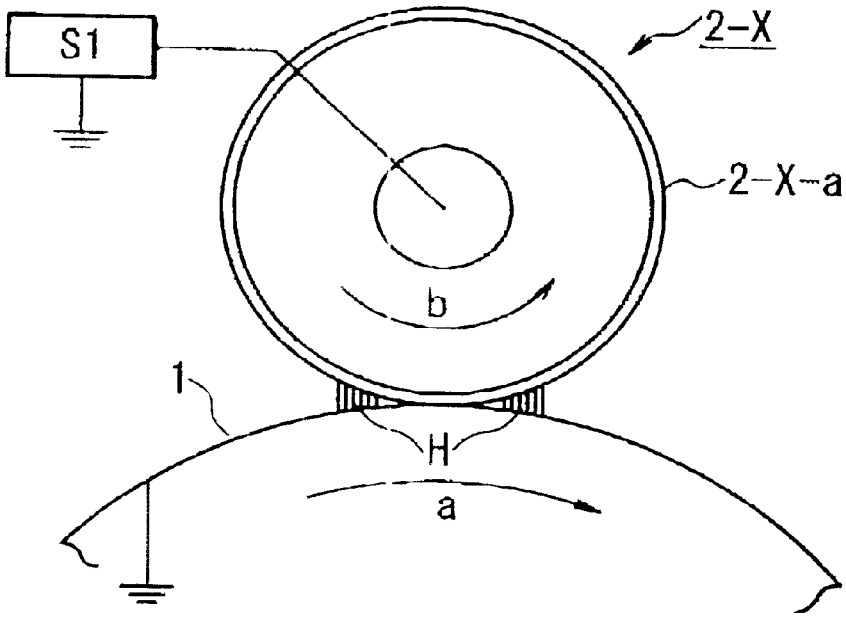
FIG. 6 is a rough vertical view of a roller type charging apparatus.

<Second Embodiment> (FIG. 5)

In this embodiment, the mode for cleaning the sponge charge roller 2-A-*a* is not automatically carried out as one of the normal processes in the operational sequence of the printer. Instead, it is activate, as a process different from the normal image formation processes, by a selection key (unshown) only when necessary. This mode is carried out with the use of a cleaning paper.

The cleaning mode sequence in this embodiment is shown in FIG. 5. In this cleaning mode, a fresh transfer medium P is placed as a cleaning paper in the sheet feeding portion. Then, after the completion of the pre-rotation, when it becomes possible for the toner on the photosensitive drum 1 to be transferred onto the cleaning paper, the application of the charge bias Vc to the sponge charge roller 2-A-*a* is started, and the rotation of the sponge charge roller 2-A-*a* is switched from the driven rotation Rc to the following rotation Rf, so that the toner is discharged from the sponge charge roller 2-A-*a* onto the peripheral surface of the photosensitive drum 1. During this period, the development bias to the developing apparatus 3 is kept off, and therefore, as the photosensitive drum 1 is further rotated, the toner, which has Just been discharged onto the photosensitive drum 1, simply goes through the development station, and reaches the transfer nip, in which the toner is transferred onto the cleaning paper which is delivered to the transfer nip from the sheet feeding portion with a predetermined control timing; in other words, the toner on the photosensitive drum 1 is removed therefrom. During this operation, a predetermined transfer bias is continuously applied to the transfer roller 5.

The cleaning mode is continued during the period F in which the toner can be transferred onto the cleaning paper, and is ended by turning off the charge bias. After passing the transfer nip, the cleaning paper passes the fixing apparatus 6, and is discharged into a delivery tray.

This ends the essential portion of the cleaning sequence. In this embodiment, however, in order to dispose of the toner particles which have remained on the photosensitive drum 1, that is, the toner particles which have failed to be transferred onto the cleaning paper, a sequence similar to the cleaning sequence in the first embodiment is carried out during the process equivalent to the post-rotation, so that the toner is recovered by the developing apparatus 3.

As the above described cleaning mode is carried out, the excessive amount of the toner adhering to the sponge charge roller, which is one of the causes of the improper charging of the photosensitive drum 1, is removed, and therefore, the sponge charge roller, the performance of which has deteriorated due to its contamination by the toner, is restored in charging performance.

As described above, the cleaning mode in this embodiment can be activated, as necessary, with the use of the selection key, and therefore, it is particularly useful in the case of an image forming system in which the contamination of the peripheral surface of the sponge charge roller by toner does not result in problems under normal conditions until the service life of the toner T in the process cartridge 4 expires. This is for the following reason That is, if a cleaning mode needs to be carried out only on the rare occasions in which paper jam frequently occurs, for example, when an image forming apparatus is used in a harsh environment, or when an unusual transfer medium is used, it is better that the cleaning mode can be activated as necessary by a user.

Although the cleaning mode in this embodiment must be activated by a user, and a cleaning paper must be prepared, most of the toner particles discharged from a sponge charge roller can be recovered with a single cleaning paper. Therefore, it is advantageous compared to the cleaning mode in the first embodiment in that the sponge charge roller can he very quickly cleaned.

In other words, the toner particles adhering to the peripheral surface of the sponge charge roller can be removed with the use of the cleaning mode in this embodiment, to stabilize the charging performance of the sponge charge roller. Therefore, it is possible to continuously output high quality images for a long period of time.

Also in this embodiment, the injection type charging system was described with reference to a charging system which employed the sponge charge roller 2-A-*a* and electrically conductive particles Z. However, the present invention is also applicable to a magnetic brush based charging system, or a fur brush based charging system, which was described as examples of the conventional charging system, for the following reason. That is, the magnetic brush or fur brush based charging system is the same as the sponge charge roller based charging system in that, because the charging member is placed in contact with the photosensitive drum 1 and is rotated in the direction counter to the rotational direction of the photosensitive drum 1, the toner is likely to be recovered by the charging apparatus from the peripheral surface of the photosensitive drum 1 in the normal process. Therefore, the provision of a process in which the difference in peripheral velocity between the charging member and photosensitive drum 1 is eliminated, and charge bias is applied while there is virtually no difference in peripheral velocity between the charging member and the photosensitive drum 1, makes it possible for the toner to be discharged from the charge roller to the peripheral surface of the photosensitive drum 1.

Further, also in the cleaning sequence in this embodiment, the sponge charge roller 2-A-*a* is made to follow the rotation of the photosensitive drum 1. However, the charging member may be driven in the same manner as is the charging member in the first embodiment, instead of making it follow the rotation of the photosensitive drum 1, in order to reduce to virtually zero, the peripheral velocity of the charging member relative to that of the photosensitive drum 1.

<Miscellaneous Embodiments>

(1) A charging member cleaning mode is not a mode carried out during any of the processes in an actual image formation sequence. It can be carried out during one, or a combination, among the multiple pre- rotation process, pre-rotation process, sheet intervals, and post-rotation process, or all of them.

(2) An image bearing member may be of a direct charge infection type provided with a charge injection layer with a surface electrical resistance of $10^9$–$10^{14}$ ohm.cm. Even if it is not provided with a charge injection layer, the same effects can be obtained, for example, when the electrical resistance of its charge transfer layer is within the above range. Further, it may be an amorphous silicon type photosensitive member, the surface layer of which has a volumetric resistivity of approximately $10^{13}$ ohm.cm.

(3) As for the material for the flexible contact type charging member, felt, fabric, or the like may also be used. Further, two or more materials may be used in combination to realize a flexible contact type charging member which is most suitable in shape, elasticity, electrical conductivity, surface properties, and durability.

(4) The wave-form of the AC component of the alternating voltage (AC component: voltage which periodically alternates in voltage value) for generating the oscillating electric field is optional. For example, it may be sinusoidal, rectangular, triangular, or the like. It may be a rectangular wave-form formed by periodically turning on and off a DC power source.

(5) The exposing means as a means for writing information on the charged peripheral surface of the photosensitive drum as an image bearing member may be a digital exposing means which employs a solid light emitting element, for example, an LED, or an analog exposing means which employs a halogen lamp, fluorescent lamp, or the like, as a light source for illuminating an original, in addition to the laser based scanning means in the preceding embodiments. In essence, any exposing means will suffice as long as it is capable of forming an electrostatic latent image in accordance with image formation data.

(6) The image bearing member may be an electrostatically recordable dielectric member or the like. When an electrostatically recordable dielectric member is used, first, the surface of the dielectric member is uniformly charged, and then, the charged surface is selectively discharged with the use of a discharging means such as a discharging needle head, an electron gun, or the like, to write an electrostatic latent image in accordance with the data of an intended image.

(7) The types of the method and means for developing an electrostatic latent image are optional They may be reversal or normal.

Generally, the methods for developing an electrostatic latent image may be divided into four groups: single component noncontact development group; single component contact development group; two component contact development group; and two component noncontact development group. In the single component noncontact development group, nonmagnetic or magnetic toner is used. When nonmagnetic toner is used, it is coated on a developer bearing/conveying member such as a blade or the like, whereas when nonmagnetic toner is used, it is coated on a developer bearing/conveying member with the use of magnetic force. The toner coated on the developer bearing/conveying member as described above is transferred onto an image bearing member, without placing the developer layer on the developer bearing/conveying member in contact with the image bearing member, to develop the electrostatic latent image on the image bearing member. In the single component contact development group, the toner coated on the developer bearing/conveying member as described above is transferred onto the image bearing member, by placing the developer layer on the developer bearing/conveying member in contact with the image bearing member, to develop the electrostatic image on the image bearing member. In the two component contact development group, a mixture of toner particles and magnetic carrier particles is used as developer (two component developer). The developer is coated on the developer bearing/conveying member with the use of magnetic force, and transferred onto the image bearing member, by placing the developer layer on the developer bearing/conveying member in contact with the image bearing member, to develop the electrostatic latent image on the image bearing member Lastly, in the two component noncontact development group, the above described two component developer is transferred onto the image bearing member, without placing the developer layer on the developer bearing/conveying member in contact with the image bearing member, to develop the electrostatic latent image on the image bearing member.

(8) The choice of the transferring means is not limited to the transfer roller based transferring means in the preceding embodiments. For example, it may be a transfer blade based transferring means, a transfer belt based transferring means, or any transferring means which uses a contact type charging method. Further, it may be a noncontact type transferring means which employs a corona based charging device.

(9) Not only is the present invention applicable to a monochromatic image forming apparatus, but also it is applicable to an full-color image forming apparatus which employs an intermediary transfer member such as a transfer drum or a transfer belt, and forms a multicolor or full-color image through a multilayer transfer process or the like.

(10) The image forming apparatus may be of a type which has a cleaning apparatus dedicated for removing the developer remaining on the peripheral surface of the image bearing member after image transfer, which is obvious.

As described above, in an injection type charging system, generally, a relatively large difference in peripheral velocity was set between a charging member and an image bearing member to realize higher charging performance. Thus, in order to effectively discharge the developer, which had adhered to, or invaded into, the charging member, onto the image bearing member, this peripheral velocity difference was reduced (to zero, or virtually zero) by switching the manner in which the charging member was rotated, from being driven independently from the image bearing member, to following the rotation of the image bearing member, and bias similar to charge bias was applied to the charging member while the peripheral velocity difference was kept at the reduced velocity. As a result, the charging member was effectively cleaned.

The present invention was made based on the above described observation. Its object is to always maintain the developer contamination level of a charging member within a tolerable range. As means for accomplishing the object, the aforementioned charging member cleaning mode (cleaning sequence) is automatically carried out during a predetermined period, which excludes the actual image forming processes of an image forming apparatus, or is manually activated when necessary.

With the application of the present invention to an image forming apparatus, in particular, an image forming apparatus which employs an injection type charging system as a means for charging an image bearing member, the charging member was efficiently cleaned without affecting the image formation. As a result, the charging performance of the charging member could be kept stable at an excellent level for a long time, and it was prevented that a defective image was produced by an excessive amount of developer which remained adhered to the charging member.

Further, the developer, which was discharged from the charging member onto the image bearing member, was recovered into the developing means, without affecting the image formation, by applying bias similar to the bias applied during the actual image formation, to the developing means while the above described charging member cleaning mode was carried out. In addition, the recovered developer was reused.

According to another aspect of the present invention, the developer, which was discharged onto the image bearing member, is removed from the image bearing member by transferring the discharge developer on the image bearing member onto a recording medium (cleaning paper) by the transferring means. Therefore, the above described discharged developer can be quickly removed, that is, the charging member is quickly cleaned, with the use of only a single piece of recording medium, without affecting the image formation.

With the application of this system in accordance with the present invention to an image forming apparatus which employs a charging apparatus which employs an electrically conductive sponge roller and electrically conductive particles (charging performance enhancement particles), the electrically conductive particles collect on the image bearing member and/or electrically conductive sponge roller, being therefore not likely to transfer onto the recording medium (cleaning paper). Therefore, the charging performance is maintained at an excellent level for a long period of time, and it is prevented that a defective image is produced due to an excessive amount of developer which remains adhered to the charging member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a charge member, contactable to said image bearing member, for electrically charging said image bearing member, said charge member being capable of being supplied with a voltage;

developing means for developing an electrostatic image formed on said image bearing member with a developer;

wherein said charge member is rotatable so as to provide a first peripheral speed difference between a surface of said charge member and a surface of said image bearing member when said image bearing member is charged for image formation;

wherein there is provided a cleaning period for transferring the developer from said charge member to said image bearing member with a second peripheral speed difference, which is smaller than said first peripheral speed difference, between the surface of said charge member of and surface of said image bearing member, when a charging operation for the image formation is not effected to the image bearing member.

2. An apparatus according to claim 1, wherein in said cleaning period, said charge member is supported with a second voltage having the same polarity as a first voltage applied to said charge member when the charging for the image formation is carried out.

3. An apparatus according to claim 2, wherein said second voltage is substantially the same as said first voltage.

4. An apparatus according to claim 1, wherein said charge member is provided with an elastic roller forming a nip between itself and said image bearing member, and electroconductive particles are provided in said nip.

5. An apparatus according to claim 4, wherein said elastic roller is provided with a sponge layer.

6. An apparatus according to claim 1, wherein the second peripheral speed difference is substantially zero.

7. An apparatus according to claim 4, wherein said charge member is rotated by said image bearing member in the cleaning period.

8. An apparatus according to claim 1, wherein a direction of a peripheral movement of said charge member its opposite from that of said image bearing member at a contact portion between said charge member and said image bearing member.

9. An apparatus according to claim 1, further comprising transferring means for transferring an image from said image bearing member onto a recording material, wherein said transferring means is capable of transferring the developer, having been transferred from said charge member onto said image bearing member, onto a cleaning sheet.

10. An apparatus according to claim 9, wherein a cleaning mode for transferring the developer, having been moved from said charge member onto said image bearing member, onto the cleaning sheet, is selectable.

11. An apparatus according to claim 1, wherein said developing means is capable of effecting a cleaning operation for collecting the developer from said image bearing member simultaneously with a developing operation for developing the electrostatic image with the developer.

12. An apparatus according to any one of claims 1–11, wherein said charge member effects injection charging to said image bearing member through a contact portion between said charge member and said image bearing member.

13. An apparatus according to claim 12, wherein said image bearing member has a surf ace layer having a volume resistivity of $10^9$–$10^{14}$ Ωcm.

* * * * *

UNITED STATES PATENT AND TRADEMARK OFFICE

CERTIFICATE OF CORRECTION

PATENT NO. : 6,434,349 B1
DATED : August 13, 2002
INVENTOR(S) : Yasushi Shimizu et al.

It is certified that error appears in the above-identified patent and that said Letters Patent is hereby corrected as shown below:

Title page,
Item [30], Foreign Application Priority Data, "2000-19943" should read -- 2000-199432 --.

Column 2,
Line 27, "rotatable" should read -- rotatable. --; and
Line 46, "S" should read -- s --.

Column 3,
Line 5, "taking" should read -- taken --;
Line 27, "accomplished" should read -- accomplished. --; and
Line 55, "2-A-e" should read -- 2-A-a --.

Column 4,
Line 20, "member" should read -- member. --; and
Line 41, "minimize" should read -- minimal --.

Column 5,
Line 53, "level" should read -- level. --.

Column 6,
Line 25, "Is" should read -- is --;
Line 40, "stations" should read -- station, --; and
Line 42, "an." should read -- an --.

Column 8,
Line 12, "an" should read -- on --; and
Line 13, "Is" should read -- is --.

Column 9,
Line 10, "uniformly" should read -- uniform --; and
Line 31, "is" should read -- are --.

Column 11,
Line 12, "drum 1" should read -- drum 1. --.

UNITED STATES PATENT AND TRADEMARK OFFICE

CERTIFICATE OF CORRECTION

PATENT NO. : 6,434,349 B1
DATED : August 13, 2002
INVENTOR(S) : Yasushi Shimizu et al.

It is certified that error appears in the above-identified patent and that said Letters Patent is hereby corrected as shown below:

Column 13,
Line 3, “3-a,” should read -- 3-a. --;
Line 4, “then,” should read -- Then, --;
Line 36, “detective” should read -- defective --; and
Line 54, “mark a,” should read -- mark s, --.

Column 15,
Line 58, “Images” should read -- images --.

Column 16,
Line 40, “activate,” should read -- activated --; and
Line 58, “Just” should read -- just --.

Column 17,
Line 38, “he” should read -- be --.

Column 18,
Line 17, “infection” should read -- injection --; and
Line 59, “optional” should read -- optional. --.

Column 19,
Line 25, “member” should read -- member. --.

Column 20,
Line 59, “voltage;” should read -- voltage; and --;
Line 62, “oper;” should read -- oper, --; and
Line 67, “formation;” should read -- formation, and --.

Column 21,
Line 6, “of” (first occurrence) should be deleted.

UNITED STATES PATENT AND TRADEMARK OFFICE

CERTIFICATE OF CORRECTION

PATENT NO. : 6,434,349 B1
DATED : August 13, 2002
INVENTOR(S) : Yasushi Shimizu et al.

It is certified that error appears in the above-identified patent and that said Letters Patent is hereby corrected as shown below:

Column 22,
Line 25, "surf ace" should read -- surface --.

Signed and Sealed this

Fifteenth Day of April, 2003

JAMES E. ROGAN
*Director of the United States Patent and Trademark Office*